US008245770B2

(12) United States Patent
Bell et al.

(10) Patent No.: US 8,245,770 B2
(45) Date of Patent: Aug. 21, 2012

(54) METHOD FOR PERFORATING FAILURE-PRONE FORMATIONS

(75) Inventors: Matthew Robert George Bell, Dallas, TX (US); David S. Wesson, Dallas, TX (US); Nathan Garret Clark, Mansfield, TX (US); John Thomas Hardesty, Dallas, TX (US)

(73) Assignee: Geodynamics, Inc., Millsap, TX (US)

( * ) Notice: Subject to any disclaimer, the term of this patent is extended or adjusted under 35 U.S.C. 154(b) by 156 days.

(21) Appl. No.: 12/627,964

(22) Filed: Nov. 30, 2009

(65) Prior Publication Data

US 2010/0132947 A1 Jun. 3, 2010

Related U.S. Application Data

(60) Provisional application No. 61/118,999, filed on Dec. 1, 2008.

(51) Int. Cl.
*E21B 43/117* (2006.01)

(52) U.S. Cl. ..... 166/55; 166/297; 102/476

(58) Field of Classification Search ..... 166/297, 166/298, 299, 55; 102/476, 307
See application file for complete search history.

(56) References Cited

U.S. PATENT DOCUMENTS

| | | | | |
|---|---|---|---|---|
| 3,235,005 | A | 2/1966 | Delacour | |
| 3,983,941 | A | 10/1976 | Fitch | |
| 4,078,612 | A | 3/1978 | Gallus | |
| 4,107,057 | A | 8/1978 | Dill et al. | |
| 4,220,205 | A | 9/1980 | Coursen et al. | |
| 4,372,384 | A * | 2/1983 | Kinney | 166/278 |
| 5,318,128 | A | 6/1994 | Johnson et al. | |
| 6,962,203 | B2 * | 11/2005 | Funchess | 166/297 |
| 7,393,423 | B2 | 7/2008 | Liu | |
| 7,712,416 | B2 * | 5/2010 | Pratt et al. | 102/307 |
| 2003/0037692 | A1 | 2/2003 | Liu | |
| 2003/0089498 | A1 | 5/2003 | Johnson et al. | |
| 2004/0089449 | A1 | 5/2004 | Walton et al. | |
| 2005/0115448 | A1 | 6/2005 | Pratt et al. | |
| 2006/0266551 | A1 | 11/2006 | Yang et al. | |
| 2007/0056462 | A1 | 3/2007 | Bates et al. | |
| 2008/0230225 | A1 * | 9/2008 | Meddes et al. | 166/297 |
| 2008/0271894 | A1 | 11/2008 | Hill et al. | |

OTHER PUBLICATIONS

GEODynamics Engineered Perforating Solutions, 2009 GEODynamics Inc., Client Spotlight, Jul. 2009.

GEODynamics Engineered Perforating Solutions, 2008.10 GEODynamics, Inc., CONNEX Perforating, ReActive Perforating Technology.

Bell, Hardesty, and Clark, "Reactive Perforating: Conventional and Unconventional Applications, Learnings, and Opportunities," SPE 122174, 2009 Society of Petroleum Engineers, May 27, 2009.

Bell and Cuthill, "Next-Generation Perforating System Enhances the Testing and Treatment of Fracture Stimulated Wells in Canada," SPE 116226, 2008, Society of Petroleum Engineers, Sep. 21, 2008.

(Continued)

*Primary Examiner* — Daniel P Stephenson
(74) *Attorney, Agent, or Firm* — David W. Carstens; Carstens & Cahoon, LLP

(57) ABSTRACT

By using reactive shaped charges to perforate failure prone formations, the present invention is able to keep formation sand in place and increase productivity. An efficient flow distribution is surprisingly produced without requiring surge flow or post-perforation stimulation. Further, using the secondary reactive effects of reactive shaped charges allows for the reduction of the risk of erosion and minimization of sand production. In a preferred embodiment, a liner capable of producing a strongly exothermic intermetallic reaction between liner components within and around the tunnel is used to achieve a high percentage of substantially clean and enlarged perforation tunnels conducive to flow or gravel packing.

10 Claims, 3 Drawing Sheets

OTHER PUBLICATIONS

Denney, "Technology Applications," JPT Online, Jul. 2007, located at http://www.spe.org/spe-app/spe/jpt/2007/07/TechApps.htm, downloaded Nov. 28, 2009.

Wade et al. "Field Tests Indicate New Perforating Devices Improve Efficiency in Casing Completion Operations" Schlumberger Well Surveying Corp. Oct. 1962, pp. 1069-1073.

* cited by examiner

METHOD FOR PERFORATING FAILURE-PRONE FORMATIONS

CROSS-REFERENCE TO RELATED APPLICATION

This application claims priority to provisional application Ser. No. 61/118,999, filed Dec. 1, 2008.

TECHNICAL FIELD

The present invention relates generally to explosively perforating a well casing and its adjacent underground hydrocarbon bearing formations, and more particularly to an improved method for explosively perforating a well casing within failure-prone formations.

BACKGROUND OF THE INVENTION

Wellbores are typically completed with a cemented casing across the formation of interest to assure borehole integrity and allow selective injection into and/or production of fluids from specific intervals within the formation. It is necessary to perforate this casing across the interval(s) of interest to permit the ingress or egress of fluids. Several methods are applied to perforate the casing, including mechanical cutting, hydrojetting, bullet guns and shaped charges. The preferred solution in most cases is shaped charge perforation because a large number of holes can be created simultaneously, at relatively low cost.

In formations where the sand is porous, permeable and well cemented together, production (i.e., the recovery of hydrocarbons from a subterranean formation) is ideal; that is, it is easier to extract large volumes of hydrocarbons from the formation and into production wells. However, in poorly consolidated formations where the rock material is poorly cemented, sand tends to flow into the wells during production, a problem known as sand production. If the sand reaches the surface, it can damage oilfield hardware and equipment, potentially leading to major failures. In addition, when the solid materials reach the surface, they must be separated from the fluids and disposed of using environmentally approved methods. Moreover, sand production can lead to poor performance in wells and lost production.

To control sand and prevent it from entering a well in order to obtain high production rates from such reservoirs typically requires some means of filtering formation material out of the fluid as it is drawn from the reservoir. Since poorly consolidated formations generally fail under the pressure drawdown applied to them during production, steps must often be taken to control the influx of solids that might otherwise plug or erode and cause the failure of subsurface and surface infrastructure. Once it is determined that a reservoir may be prone to sanding, traditional methods can be implemented to provide a barrier to sand so that it does not enter the well with the hydrocarbons. The methods are typically chosen based on the physical characteristics of the reservoir. For example, sand control measures, such as mechanical filters known as "sand screens" and the packing of gravel around such filters, are often implemented to deal with sand production problems which would otherwise lead to undesirable events such as wellbore collapse and equipment failure. Various sand control techniques have evolved for either limiting the influx of solids, or constructing a mechanical filter to retain loose solids at the sand face, or co-producing solids with the hydrocarbons in a controlled manner.

The most common method of controlling sand production is the installation of one or more sand screens during well completion. Sand screens filter or "screen" the flow of hydrocarbons as they enter the wellbore, allowing fluids to easily pass while preventing sand entry. FIG. 1 illustrates a prior art method for the perforation of sanding prone completions wherein a sand screen 30 is used as a mechanical filter. Screens 30 may be used as filters by sizing the screen to block the flow of particles larger than a given size. Traditionally, a sieve analysis is performed on samples of the formation sand prior to completion of the well and the formation sand particle size range is determined. A filter screen aperture size is chosen which will allow the sand particles to bridge effectively across the screen apertures but not unduly block them. A common criterion for determining screen aperture width is six times the median particle size diameter ($6\ D_{50}$).

The installation of a stand-alone mechanical filter, around which produced solids will accumulate over time to form a natural sand pack filter, is sometimes appropriate. Such installations, however, are vulnerable to erosion of the mechanical filter due to high velocity ingress of fluids through a limited number of inflow points. For example, if a high percentage of perforated tunnels are blocked with debris 22, the fluid inflow from a formation is forced to enter through the few open tunnels, subjecting the filter 32 adjacent to the formation's open tunnels to high erosion because the fluid flow impinges directly onto the filter material at high velocity. A further effect of the influx of formation fluids through a limited set of perforations is an increased risk of sand production due to the high flux rate through the few open tunnels available. The propensity for erosion can be reduced by maximizing the number of perforations open for influx, or by circulating gravel into place around the sand screen to act as a primary filter.

FIG. 2 illustrates a prior art method of completing failure-prone formations to restrain sand production. Gravel packing is accomplished by placing a screen 30 in the wellbore across the intended production zone, then filling the annular area between the screen 30 and the formation 12 with appropriately sized, highly permeable sand 42. The gravel pack sand 42 is sized so that it will not flow into the production equipment but will block the flow of formation sand into the wellbore. Ideally, uniform gravel packing is desired in all tunnels, in order to create an effective filter. However, in reality, ineffective gravel placement often occurs, creating voids 40 within the annular area. This phenomenon is exacerbated by uneven leak-off of fluid from the wellbore into the formation as a result of plugged perforation tunnels. The resulting voids 40 may lead to damage of the filter as a result of erosion 32, also known as "hot spotting", causing premature failure of the sand filter during production. Big-hole charges, designed to create perforations with a large diameter entrance hole of about 0.8-1.0 inches in diameter are typically used in sand control completions to create as much open flow area (cross sectional area of the holes) in the casing as possible, so as to avoid issues such as hot-spotting and erosion. Perforation tunnel length and geometry is generally less important when using these big-hole charges. While gravel packing has evolved into a complex science, ineffective gravel placement within the perforation tunnels due to the insufficient clean up of perforation tunnels remains a significant problem.

Prior art methods of minimizing sand production without installation of a mechanical filter require that the pressure drop applied across each perforation be minimized to limit rock failure, and the flux rate through each contributing perforation tunnel be minimized to limit the transport of loose grains. This can be achieved by limiting the drawdown applied during production and by maximizing the number of perforations open for influx. However, the latter often requires secondary clean-up activities such as inducing surge flow (at risk of catastrophic sand production) or pumping a clean-up treatment such as an acid to remove soluble debris from blocked perforation tunnels. Creation of surge flow requires running additional equipment and creates a risk of producing undesired amounts of material into the wellbore.

Consequently, there is a need for an improved and economical method for cleaning up tunnels and for substantially sand-free production from failure-prone formations. Such methods should allow for control over or minimization of the production of unwanted sand. The method should adequately clean tunnels without the need for running additional equipment that could cause an influx of sand into the wellbore. The method should eliminate the need for secondary cleanup activities prior to production and/or installation of a sand control completion. Finally, there is a need for a method that provides for the minimization or elimination of any risk of failure of the sand control or production equipment.

SUMMARY OF THE INVENTION

The present application provides an improved method for the perforation of failure-prone formations by using reactive shaped charges to reduce the propensity for sand production while increasing productivity in a sand co-production application. In one embodiment, the present invention uses reactive shaped charges to enhance the installation and longevity of a sand control completion. In another embodiment, the present invention provides for perforation without the subsequent installation of a sand control filter.

Conventional wisdom dictates that the additional release of energy in a sanding-prone formation is undesirable, as it could increase the risk of failure of the formation. However, it has been found that the controlled expulsion of debris from the perforation tunnels, which is provided by reactive shaped charges, is more reliable and less risky than conventional clean-up techniques such as surging or chemical treatments.

Using the method of the present invention, customary subsequent activity such as surge flow or post-perforation stimulation treatment is no longer necessary. Commercial flow rates of oil or gas can be extracted from the wellbore while applying a lower than normal pressure drawdown of a magnitude that would not induce formation failure or cause the onset of sand production. A second, local reaction within each cavity or perforated tunnel, expelling small amounts of material from a well actually produces a number of benefits. It enables the more efficient gravel packing of a well wherein a mechanical filter (i.e., "sand screen") has been installed and ensures a substantially uniform distribution of inflow across a large number of entry points, resulting in a reduced risk of sand filter failure due to erosion and a reduced risk of voids forming where there is insufficient outflow of carrier fluid into the perforated interval. Second, in certain formations where the increased flow area resulting from perforation with reactive charges is sufficient to reduce the influx per open perforation to the point where excessive sand production is avoided, the present invention allows for perforation without subsequent installation of a sand control filter. Third, by using the present invention, increased longevity of mechanical sand control completions (sand screens) is achieved due to a reduced influx per perforation impinging on the sand screen as a result of increased number of open perforations and, where applicable, ideal packing of each perforation tunnel. Fourth, an improved outflow distribution is produced across the perforated interval during an extension pack or frac-and-pack completion due to higher percentage of producing cavities or disturbed regions of material. This results in an improved inflow potential and inflow distribution across the completed interval. Fifth, an improved production from wells where sand is co-produced with the hydrocarbons—typically heavy- and extra-heavy crude—is experienced with the present invention due to a greater number of enlarged, substantially debris-free tunnels and the onset of sand co-production being triggered by the reactive event in each tunnel.

BRIEF DESCRIPTION OF THE DRAWINGS

A more complete understanding of the method and apparatus of the present invention may be had by reference to the following detailed description when taken in conjunction with the accompanying drawings, wherein.

DETAILED DESCRIPTION OF THE PREFERRED EMBODIMENTS

Current knowledge dictates that due to the poorly consolidated nature of failure prone formations, any additional energy or reactive detonation within a perforation tunnel would cause immediate production of formation and solids material into the wellbore. Therefore, the additional energy released by reactive shaped charges has until now been seen more as a hazard than a benefit, as it should cause immediate failure of the formation into the wellbore. However, it has been found that the use of reactive shaped charges in failure-prone formations reduces the flux rate per perforation and eliminates surge flow steps, thereby reducing the risk of formation failure rather than causing it.

As used herein, the terms "failure-prone formation," "poorly consolidated formation," "sanding-prone formation," and "sand production prone formation" are used interchangeably and are meant to refer to an unconsolidated subterranean formation and/or loosely consolidated formation wherein the particulate materials comprising the formation are loosely associated and tend to be produced into the wellbore with produced fluids. As a result, the solids within the formation are prone to disaggregation when a pressure drop is applied or flow passes through due to draft from fluid or gas. This drag causes the sand to become detached and flow into the perforations.

Figure 3A:
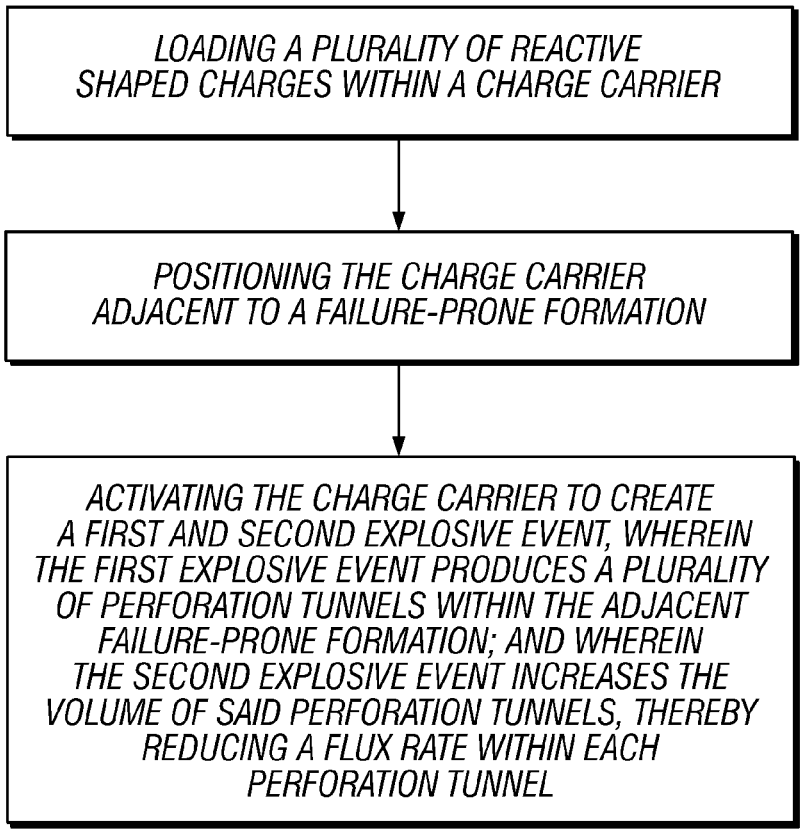
FIG. 3*a* is a flow chart of the present invention.
Figure 3B:
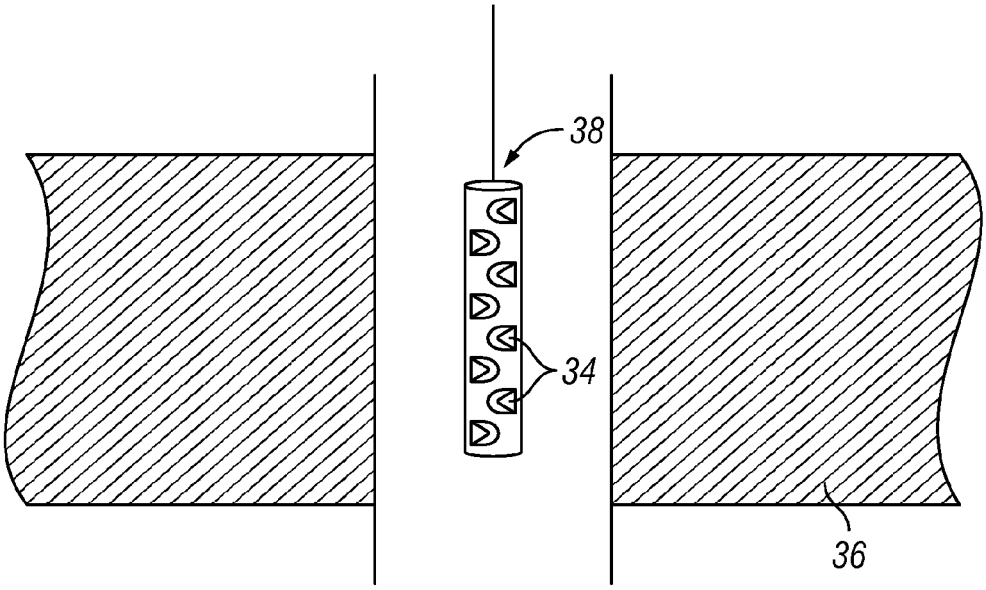
FIG. 3*b* is a cross-sectional view of a method for perforation as reflected in FIG. 3*a*.

By perforating a poorly consolidated formation with reactive shaped charges, an overall reduction in the risks associated with sand production and of sand control equipment failure can be achieved. One skilled in the art will recognize whether a well comprises failure prone formations that tend to produce sand. For example, in one embodiment, the potential for sand production can be determined through observation of the performance of nearby offset wells. In other embodiments, determination of whether a formation has such a potential can be made by acquiring certain knowledge of the formation including without limitation the strength of the rock formation and any in-situ earth stresses in the rock. FIG. 3A contains a flow chart of the general method of the present invention, which can be applied once it is determined that a formation has stability issues. The method for perforation of a failure-prone formation (shown in FIG. 3B) comprises loading a plurality of reactive shaped charges 34 into a charge carrier 38 of a perforation gun and positioning charge carrier 38 down a wellbore adjacent to a failure-prone formation 36. The charge carrier is then activated to create a first and second explosive event, wherein the first explosive event produces a plurality of perforation tunnels within the adjacent failure-prone formation, and wherein the second explosive event increases the volume of said perforation tunnels, thereby reducing a flux rate within each perforation tunnel.

The effect of the second explosive event is to disrupt and expel debris created by the perforating event in the failure-prone formation, leaving a substantially unobstructed cavity. Importantly, the secondary reaction effectively enlarges the diameter of said perforation tunnels and reduces the flow velocity within each perforation tunnel, thereby reducing the drag force exerted on the solid particles and keeping the particles in place. The increased lateral energy released into the formation by the reactive event essentially disrupts an enhanced volume of rock around the perforation tunnel, some of which is expelled, resulting in an improved connection to the reservoir without the need for subsequent surge flow activities.

An explosive event is one, for example, caused by one or more powders used for blasting, any chemical compounds, mixtures and/or other detonating agents. An explosive event may be caused using any device that contains any oxidizing and combustible units, or other ingredients in such proportions, quantities, or packing that ignition may cause an explosion, or a release of heat or energy sufficient to produce open cavities in an adjacent formation. Detonation can be caused, without limitation, by fire, heat, electrical sparks, friction, percussion, concussion, or by detonation or reaction of the compound, mixture, or device or any part thereof.

Following detonation of a reactive shaped charge, the second explosive event is preferably substantially contained within each of the perforated cavities such that it reacts locally within each individual cavity, or independent from the other cavities (i.e., tunnels) to effectively expel debris from within the tunnel. Due to the enlarged diameter of the tunnels and an increase in the amount of tunnels produced, there is an overall greater flow area within the formation. Subsequent reduction in solids production is thus due to lower flux rates (or the lower velocity of fluid exiting the formation), calculated as the flow rate divided by the flow area. The lower the flux rate, the lower the drag forces acting on sand grains. Thus, less solids material will move and as a result, there is less sand production.

In one embodiment, perforated cavities in a sanding prone formation are cleaned by inducing one or more strong exothermic reactive effects to generate near-instantaneous overpressure within and around an individual tunnel. Preferably, the reactive effects are produced by reactive shaped charges having a liner manufactured partly or entirely from materials that will react inside the perforation tunnel, either in isolation, with each other, or with components of the formation. In one embodiment, the shaped charges comprise a liner that contains a metal, which is propelled by a high explosive, projecting the metal in its molten state into the perforation created by the shaped charge jet. The molten metal is then forced to react with water that also enters the perforation, creating a reaction locally within the perforation. In preferred embodiments, the reactive shaped charge itself comprises controlled amounts of reactive elements. In one embodiment, for example, the shaped charges comprise a liner having a controlled amount of bimetallic composition which undergoes an exothermic intermetallic reaction. In another preferred embodiment, the liner is comprised of one or more metals that produce an exothermic reaction after detonation.

Reactive shaped charges, suitable for the present invention, are disclosed in U.S. Pat. No. 7,393,423 to Liu and U.S. Patent Application Publication No. 2007/0056462 to Bates et al., the technical disclosures of which are both hereby incorporated herein by reference. Liu discloses shaped charges having a liner that contains aluminum, propelled by a high explosive such as RDX or its mixture with aluminum powder. Another shaped charge disclosed by Liu comprises a liner of energetic material such as a mixture of aluminum powder and a metal oxide. Thus, the detonation of high explosives or the combustion of the fuel-oxidizer mixture creates a first explosion, which propels aluminum in its molten state into the perforation to induce a secondary aluminum-water reaction, causing a second reaction. Bates et al. discloses a reactive shaped charge made of a reactive liner made of at least one metal and one non-metal, or at least two metals which form an intermetallic reaction. Typically, the non-metal is a metal oxide or any non-metal from Group III or Group IV, while the metal is selected from Al, Ce, Li, Mg, Mo, Ni, Nb, Pb, Pd, Ta, Ti, Zn, or Zr. After detonation, the components of the metallic liner react to produce a large amount of energy.

Figure 1:
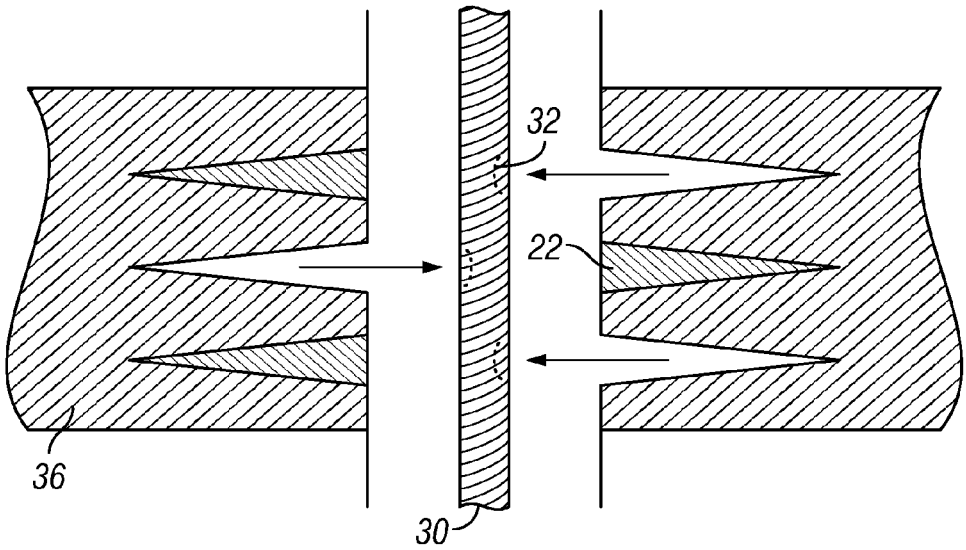
FIG. 1 (Prior Art)
FIG. 1 is a cross-sectional view of a prior art method for the perforation of failure or sanding prone formations wherein a sand screen is used as a mechanical filter.
Figure 2:
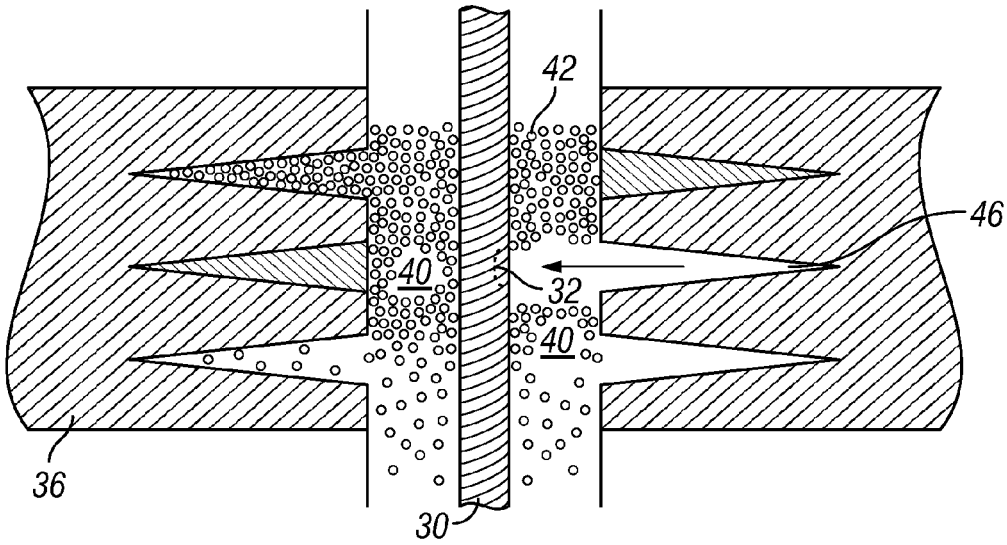
FIG. 2 (Prior Art)
FIG. 2 is a cross-sectional view of a prior art method wherein gravel packing is used for sanding control completion.
Figure 4:
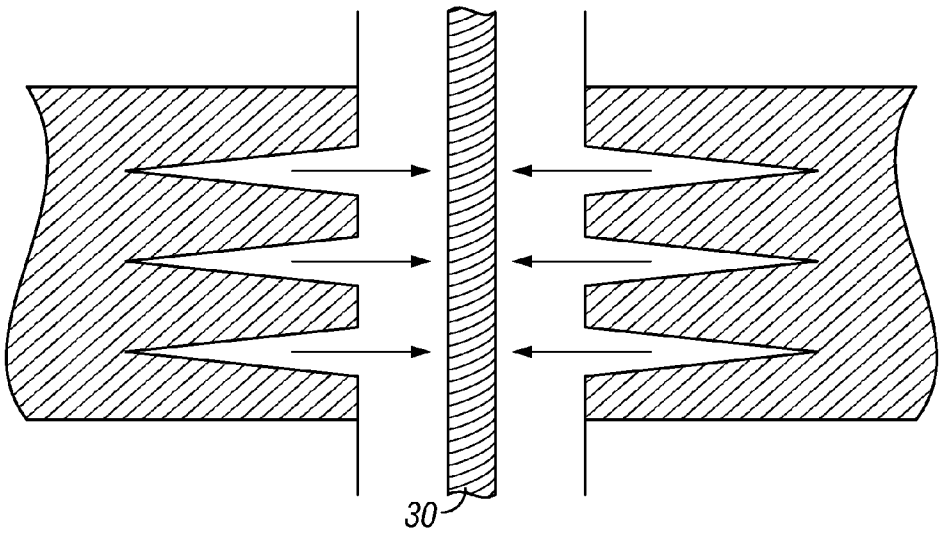
FIG. 4 is a cross-sectional view of the method of present invention applying reactive shaped charges to a sand control completion comprising a sand screen.

FIG. 4 depicts a cross-sectional view of one embodiment of the method of the present invention after applying reactive shaped charges to a sand control completion comprising a sand screen. Typically with prior art methods of perforating within regions or formations determined to have such formation stability issues, a clear tunnel is generally not formed, but rather a region of rearranged material having greater porosity and permeability and reduced cohesion compared to the surrounding rock. However, with the present invention, after the detonation of the perforating system, the second, local reaction within each perforation tunnel creates a substantially more defined and substantially debris free zone, which remains conducive to flow. While some debris may remain within the tunnels, the clean-up caused by the second release of energy substantially improves the connection between the formation and the wellbore and production, increasing the number and diameter of clean tunnels by an amount sufficient to reduce the flux rate through each tunnel, and thereby minimize sand production. The cleaned and productive tunnels further allow for the flow to be distributed over many holes, decreasing the risk of erosion and sand production typically encountered when using stand alone sand screens as a sand control completion measure. In contrast, using prior art methods, the tunnels are not generally as defined as shown in FIG. 1, and may require post-perforation surge flow or other cleanup methods to achieve an acceptable number of substantially unobstructed regions or connections to the formation.

Figure 5:
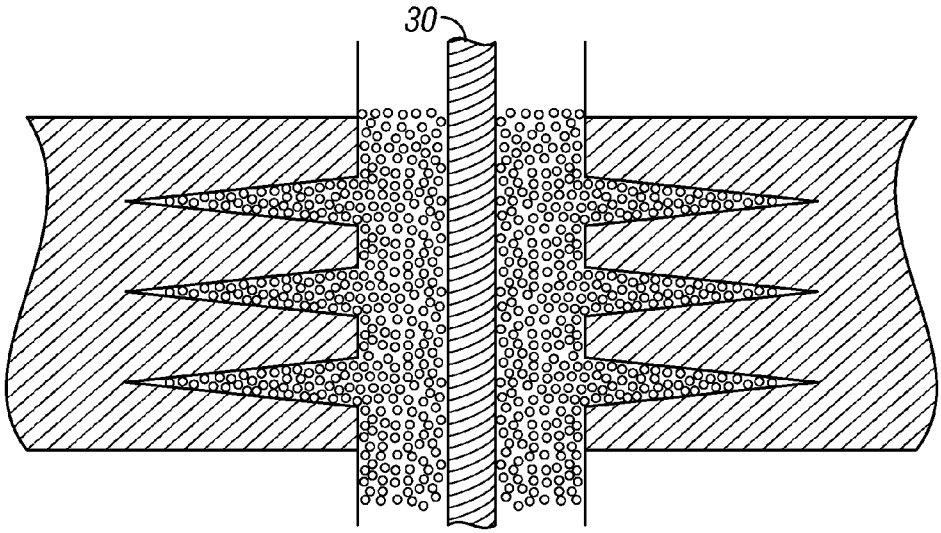
FIG. 5 is a cross-sectional view of the method of present invention applying reactive shaped charges to a sand control completion comprising the gravel packing method.

FIG. 5 is a cross-sectional view of one embodiment of the method of present invention applying reactive shaped charges to a sand control completion comprising the gravel packing method. By using reactive shaped charges, a more ideal situation is surprisingly achieved, wherein uniform packing occurs in all tunnels, creating a more effective filter around the sand screen. This improved perforation efficiency and tunnel cleanout reverses the detrimental effects described above when using conventional perforators, ensuring greater, more uniformly distributed inflow and/or outflow across the perforated interval.

The disruption of a greater amount of rock around the tunnel is surprisingly beneficial to sand co-production techniques. Laboratory studies comparing perforations shot with conventional and reactive perforators have shown that the reactive shaped charges consistently deliver significantly larger diameter tunnels. In practice within the industry, in one example using reactive shaped charges in a sand production prone formation, the gross liquids (i.e. oil and water) production from the well was found to be twice that of typical offset wells while total solids production measured at regular intervals during well clean-up and production was found to be one-tenth that measured in neighboring wells, which used conventional shaped charges.

Even though the figures described above have depicted all of the explosive charge receiving areas as having uniform size, it is understood by those skilled in the art that, depending on the specific application, it may be desirable to have different sized explosive charges in the perforation gun. It is also understood by those skilled in the art that several variations can be made in the foregoing without departing from the scope of the invention. For example, the particular location of the explosive charges can be varied within the scope of the invention. Also, the particular techniques that can be used to fire the explosive charges within the scope of the invention are conventional in the industry and understood by those skilled in the art.

It will now be evident to those skilled in the art that there has been described herein an improved perforation gun that reduces the amount of debris left in the perforations in the hydrocarbon bearing formation after the perforation gun is fired without the need for the surge flow typically used to clear debris from perforation tunnels. Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention

What is claimed is:

1. A method for reducing sand production in the perforation of a failure-prone formation, comprising:

a) loading a plurality of reactive shaped charges within a charge carrier, wherein each of the shaped charges comprises a liner made of at least two metals;

b) positioning the charge carrier adjacent to a failure-prone formation;

c) activating the charge carrier to create a first and second explosive event, wherein the first explosive event produces a plurality of perforation tunnels within the adjacent failure-prone formation; and wherein the second explosive event is caused by a bimetallic reaction from the two metals of the reactive shaped charges, said second explosive event increasing the volume of said perforation tunnels and reducing a flux rate within each perforation tunnel, thereby minimizing sand production in the failure-prone formation.

2. The method of claim 1, wherein step c) is performed without the application of a pressure differential.

3. The method of claim 1, wherein no surge flow is subsequently performed.

4. The method of claim 1, wherein the plurality of clear perforation tunnels enables a uniform gravel packing of a well.

5. The method of claim 1 further comprising no subsequent installation of a sand control filter.

6. The method of claim 1 further comprising installation of a sand filter.

7. The method of claim 1, wherein first and second explosive events take place within microseconds.

8. The method of claim 1, wherein the flux rate is reduced by increasing the diameter of any of the plurality of said perforation tunnels.

9. The method of claim 1, wherein the flux rate is reduced by increasing the length of any of the plurality of said perforation tunnels.

10. The method of claim 1, wherein said second explosive event increases the number of said plurality of perforation tunnels.

* * * * *